US009928947B1

(12) United States Patent
Lee

(10) Patent No.: US 9,928,947 B1
(45) Date of Patent: Mar. 27, 2018

(54) METHOD OF FABRICATING HIGHLY CONDUCTIVE LOW-OHMIC CHIP RESISTOR HAVING ELECTRODES OF BASE METAL OR BASE-METAL ALLOY

(71) Applicant: National Cheng Kung University, Tainan (TW)

(72) Inventor: Wen-Hsi Lee, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 0 days.

(21) Appl. No.: 15/653,656

(22) Filed: Jul. 19, 2017

(51) Int. Cl.

| | |
|---|---|
| ***H01C 1/012*** | (2006.01) |
| ***H01C 7/00*** | (2006.01) |
| ***H01C 17/28*** | (2006.01) |
| ***H01C 17/065*** | (2006.01) |
| ***H01C 1/14*** | (2006.01) |
| ***H01C 17/00*** | (2006.01) |
| ***H01C 7/02*** | (2006.01) |

(52) U.S. Cl.
CPC ..... *H01C 7/003* (2013.01); *H01C 1/14* (2013.01); *H01C 7/021* (2013.01); *H01C 17/006* (2013.01); *H01C 17/06526* (2013.01); *H01C 17/281* (2013.01)

(58) Field of Classification Search
CPC ..... H01C 7/003; H01C 7/021; H01C 1/14; H01C 17/006; H01C 17/06526; H01C 17/281
USPC ..... 338/309
See application file for complete search history.

(56) References Cited

U.S. PATENT DOCUMENTS

| | | | | |
|---|---|---|---|---|
| 4,780,702 A * | 10/1988 | Snel | H01C 1/142 | 338/308 |
| 5,680,092 A * | 10/1997 | Yamada | H01C 7/006 | 338/308 |
| 5,907,274 A * | 5/1999 | Kimura | H01C 1/142 | 338/308 |
| 6,153,256 A * | 11/2000 | Kambara | H01C 17/006 | 29/613 |
| 6,356,184 B1 * | 3/2002 | Doi | H01C 1/148 | 338/309 |
| 7,782,173 B2 * | 8/2010 | Urano | H01C 1/012 | 338/307 |

(Continued)

*Primary Examiner* — Kyung Lee
(74) *Attorney, Agent, or Firm* — Jackson IPG PLLC; Demian K. Jackson

(57) ABSTRACT

A low-ohmic chip resistor with high conductivity is fabricated. The chip resistor has an electrode of a base metal or base-metal alloy. The base-metal or base-metal-alloy electrode and a resistor layer are fabricated through thick-film printing with sintering at a low temperature in the air. Therein, a thick-film paste made of a cheap low-reduction-potential metal (such as aluminum (Al) or nickel (Ni)) is formed through screen-printing and sintering. Then, the layer of the cheap low-reduction-potential metal is used as a sacrificial layer to be immersed in a metal solution having a high reduction potential. Therein, a wet chemical alternation reaction is processed for obtaining a metal electrode having the high reduction potential. Or, the sacrificial layer may be immersed in a mixed solution of several different metal having high reduction potential to process wet chemical alternation reaction for obtaining an alloy of metal mixed with different composition.

10 Claims, 8 Drawing Sheets

(56) References Cited

U.S. PATENT DOCUMENTS

| | | | | |
|---|---|---|---|---|
| 7,907,046 | B2 * | 3/2011 | Tsukada | H01C 1/012<br>29/621 |
| 2013/0321121 | A1 * | 12/2013 | Ohbayashi | H01C 1/14<br>338/307 |
| 2016/0372242 | A1 * | 12/2016 | Lee | H01C 1/14 |

* cited by examiner (a)

$Cu_{100}$ $Cu_{52}Ni_{48}$

METHOD OF FABRICATING HIGHLY CONDUCTIVE LOW-OHMIC CHIP RESISTOR HAVING ELECTRODES OF BASE METAL OR BASE-METAL ALLOY

TECHNICAL FIELD OF THE INVENTION

The present invention relates to fabricating low-ohmic chip resistors; more particularly, to expelling the traditional feature of using a heat treatment in a high-temperature reduction for fabricating base-metal or base-metal-alloy electrodes, where the base-metal or base-metal-alloy electrodes and resistor layers are fabricated through thick-film printing with sintering at a low temperature in the air for significantly decreasing manufacture cost.

DESCRIPTION OF THE RELATED ARTS

Nowadays, if a thick-film printed electrode is of an expensive noble metal (such as a silver (Ag) or palladium (Pd)), it can be formed through sintering at a high temperature in the air. Conversely, if the thick-film printed paste is of a cheap base metal (such as copper (Cu) or nickel (Ni)), it must be sintered in a reduction atmosphere to avoid oxidation of the base metal at high temperature.

Furthermore, the current production for alloy electrode or resistor requires a high temperature under a suitable sintering atmosphere, where every individual metal material is synthesized into an alloy material as a required element for subsequent production processes. However, due to the need of the high temperature under the suitable sintering atmosphere, the alloy material is very expensive.

As being different from the material of noble metal (such as Ag and Pd) for fabricating the metal electrode, the material of base metal (such as Cu and Ni) may be easily oxidized during heat treatment. Hence, traditionally, on making a thick-film base-metal or base-metal-alloy electrode, a thick-film formation through screen-printing is used and the heat treatment must be processed at a high temperature under a reduction atmosphere for fabricating the thick-film base-metal or base-metal-alloy electrode. Although the base-metal oxidation can be avoided, it is bound to increase manufacture cost. Hence, the prior arts do not fulfill all users' requests on actual use.

SUMMARY OF THE INVENTION

The main purpose of the present invention is to fabricate a base-metal or base-metal-alloy electrode and resistor layer through thick-film printing with sintering at a low temperature in the air.

Another purpose of the present invention is to obtain a metal electrode having a high reduction potential, where a thick-film paste made of a cheap metal (such as aluminum (Al) or Ni) having a low reduction potential is formed through screen-printing and sintering; then, the layer of the cheap metal is used as a sacrificial layer to be immersed in a metal solution having a high reduction potential to process a wet chemical alternation reaction for obtaining a metal electrode having the high reduction potential; or, the sacrificial layer may be immersed in a mixed solution of several different metal having high reduction potential to process wet chemical alternation reaction for obtaining an alloy of metals with different composition.

Another purpose of the present invention is to expel the traditional feature of using a heat treatment in a high-temperature reduction atmosphere for fabricating a base-metal or base-metal-alloy electrode, where the manufacture cost of the base-metal or base-metal-alloy electrode is greatly improved in the market; and efficiency is significantly enhanced in the technical level with the thick-film printing combined.

To achieve the above purposes, the present invention is a method of fabricating a highly conductive low-ohmic chip resistor having an electrode of base metal or base-metal alloy, comprising steps of (a) printing and sintering terminal electrodes and resistor layer, (b) plating, (c) processing heat treatment, (d) printing and sintering inner coating layer, (e) laser-cutting, (f) printing and sintering outer coating layer, (g) printing code layer, (h) breaking into strips, (i) printing side terminal electrodes with edges, (j) breaking into dices, and (k) electroplating, where step (a) comprises steps of (a1) printing two back terminal electrodes on a back surface of a substrate, (a2) printing a thick paste to cover all over a front surface of the substrate opposite to the front surface, and (a3) sintering the substrate in a sintering furnace at a high temperature of 200~900 celsius degrees (° C.); the two back terminal electrodes are spaced and unconnected and are of Al or tin (Sn) having a low reduction potential; the thick paste comprises a front terminal electrode and a resistor layer; the front terminal electrode and the resistor layer are of Al or Sn having the low reduction potential; the front terminal electrode and the resistor layer are thus obtained integrally without interface therebetween; the two back terminal electrodes, together with the thick paste comprising the front terminal electrode and the resistor layer, are thus bound to the substrate; in step (b), the thick paste is immersed as a sacrificial layer in a base-metal solution of Cu, Ni, or a CuNi alloy having a high reduction potential to process a wet-chemical alternation reaction to obtain the front terminal electrode and the resistor layer both of Al or Sn having the high reduction potential; the wet-chemical alternation reaction is processed by dip-plating or electroplating; in step (c), the front terminal electrode and the resistor layer are dried in the air; step (d) comprises steps of (d1) printing an inner coating layer on the resistor layer, and (d2) sending the substrate into a sintering furnace to sinter the inner coating layer and the resistor layer altogether at a temperature of 150~700° C.; the inner coating layer has a size equal to the resistor layer and is not in touch with the front terminal electrode; in step (e), the substrate is sent into a laser-cutting device to cut the resistor layer with a laser penetrating through the inner coating layer; a required adjusting groove is cut out from the resistor layer by the laser to modify a resistance of the resistor layer; step (f) comprises steps of (f1) printing and forming an outer coating layer on surface of the inner coating layer, and (f2) sending the substrate into a sintering furnace to sinter the outer coating layer, the inner coating layer and a part of the front terminal electrode altogether at a temperature of 150~250° C.; the outer coating layer has a size larger than the inner coating layer and is in touch with the part of the front terminal electrode; and the rest part of the front terminal electrode is exposed out; a protective layer comprising the outer coating layer and the inner coating layer is formed; in step (g), a layer printed with an identification code is formed on the protective layer to represent the chip resistor; in step (h), a whole sheet of the substrate is sent into a rolling device to be broken into strips in a rolling-cutting way; step (i) comprises steps of (i1) printing a conductive material on two side surfaces of the strips of the substrate to obtain two side terminal electrodes over at two ends of the outer coating layer, and (i2) sintering the strips of the substrate in a sintering furnace at a temperature of 150~250° C.; the side terminal electrodes cover the front terminal electrode and the back terminal electrodes; the side terminal electrodes, the front terminal electrode and the back terminal electrodes are thus sintered together; the side terminal electrodes are in touch with the front terminal electrode and are connected to the resistor layer; the front terminal electrode is thus connected and conducted with the two back terminal electrodes at two sides of the strips of the substrate separately; in step (j), the strips of the substrate are broken into dices with the rolling device; the strips of the substrate comprises the dices originally-connected to be broken into independent ones; each independent one of the dices comprises the front terminal electrode, the resistor layer, the two back terminal electrodes, the two side terminal electrodes, and the protective layer comprising the inner coating layer and the outer coating layer; in step (k), each independent one of the dices is electroplated with Ni and Sn in a plating trough to form a plated layer over each one of the side terminal electrodes; Ni protects the front terminal electrode; and the chip resistor is soldered on a printed circuit board (PCB) with Sn. Accordingly, a novel method of fabricating a highly conductive low-ohmic chip resistor having electrodes of base metal or base-metal alloy is obtained.

BRIEF DESCRIPTION OF THE DRAWINGS

The present invention will be better understood from the following detailed description of the preferred embodiment according to the present invention, taken in conjunction with the accompanying drawings, in which.

DESCRIPTION OF THE PREFERRED EMBODIMENT

The following description of the preferred embodiment is provided to understand the features and the structures of the present invention.

Figure 1:
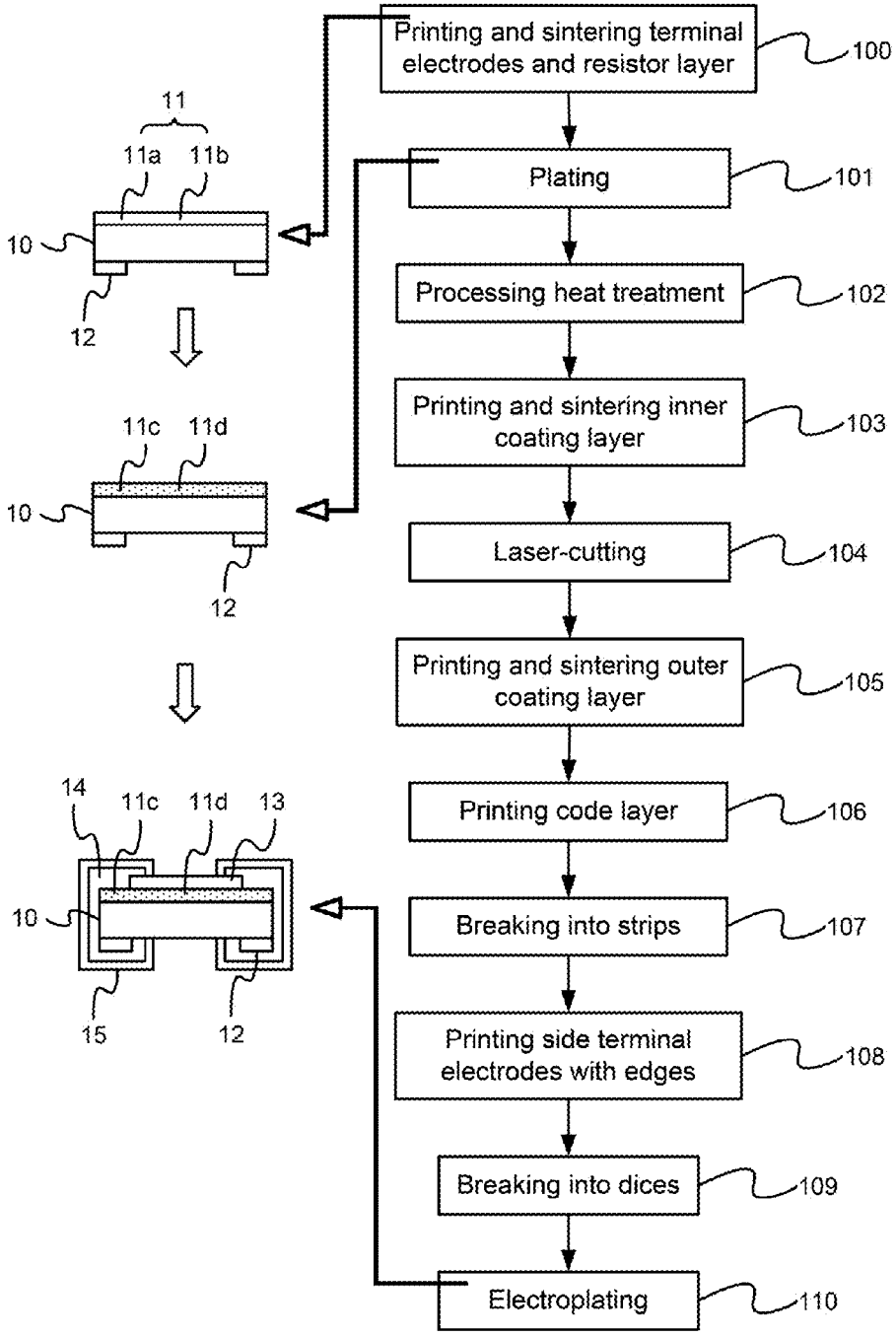
FIG. 1 is the flow view showing the preferred embodiment according to the present invention.

Please refer to FIG. 1~FIG. 5B, which are a flow view showing a preferred embodiment according to the present invention; cross-sectional views showing structures of a prior art and the present invention; views showing thick pastes and their micro-structures obtained after a wet-chemical alternation reaction; and views showing electrical characteristics. As shown in the figures, the present invention is a method of fabricating a highly conductive low-ohmic chip resistor having an electrode of base metal or base-metal alloy. A ceramic substrate having alumina oxide is used for fabricating a chip resistor with a wet thick-paste printing, comprising steps of printing and sintering terminal electrodes and resistor layer; plating; processing heat treatment; printing and sintering inner coating layer; laser-cutting; printing and sintering outer coating layer; printing code layer; breaking into strips; printing side terminal electrodes with edges; breaking into dices; and electroplating. Through the above steps, a highly conductive low-ohmic chip resistor is fabricated. In FIG. 1, the present invention comprises the following steps:

(a) Printing and sintering terminal electrodes and resistor layer 100: At first, two spaced and unconnected back terminal electrodes 12 of aluminum (Al) or tin (Sn) having a low reduction potential are printed and formed at proper positions on a back surface of a substrate 10. Then, a thick paste 11 of Al or Sn having the low reduction potential is printed all over on a front surface of the substrate 10, which comprises a front terminal electrode 11*a* and a resistor layer 11*b*. Thus, the front terminal electrode 11*a* and the resistor layer 11*b* both of the same material having the low reduction potential are thus formed integrally without interface therebetween. Then, the substrate 10 is sent into a sintering furnace to be sintered at a high temperature of 200~900 celsius degrees (° C.). Thus, the two back terminal electrodes 12 of Al or Sn having the low reduction potential, and the thick paste comprising the front terminal electrode 11*a* and the resistor layer 11*b* both of Al or Sn having the low reduction potential, are thus bound to the substrate 10. Therein, the front terminal electrode 11*a* having the low reduction potential is an Al electrode having a high solid content (which comprises a high Al content and a high glass content) or a porous Al electrode having a low solid content.

(b) Plating 101: The thick paste 11 of Al or Sn having the low reduction potential obtained after being printed and formed is used as a sacrificial layer to be immersed in a base-metal solution having a high reduction potential to process a wet-chemical alternation reaction by dip plating or electroplating for obtaining the front terminal electrode 11*c* and the resistor layer 11*d* both of a base metal or a base-metal alloy having the high reduction potential.

(c) Processing heat treatment 102: The front terminal electrode 11*c* and the resistor layer 11*d* both of the base metal or the base-metal alloy having the high reduction potential obtained after being dip-plated or electroplated are dried in the air, or are further sintered under a low-temperature reduction atmosphere.

(d) Printing and sintering inner coating layer 103: An inner coating layer 131 is printed and formed on the resistor layer 11*d* of the base metal or base-metal alloy obtained after being dried or further sintered under the reduction atmosphere. The inner coating layer 131 has a size equal to the resistor layer 11*d* of the base metal or base-metal alloy, and is not in touch with the front terminal electrode 11*c* of the base metal or base-metal alloy. Then, the substrate 10 is sent into a sintering furnace to be sintered at a temperature of 150~700° C. so that the inner coating layer 131 and the resistor layer 11*d* of the base metal or base-metal alloy are sintered altogether. Therein, the inner coating layer 131 is an insulator mainly glass-based.

(e) Laser-cutting 104: The substrate 10 is sent into a laser-cutting device to cut the resistor layer 11*d* of the base metal or base-metal alloy with a laser penetrating through the inner coating layer 131. An adjusting groove having a proper shape (like 'I', 'L', '-', etc.) is cut out from the resistor layer 11*d* of the base metal or base-metal alloy to modify a resistance of the resistor layer 11*d* of the base metal or base-metal alloy.

(f) Printing and sintering outer coating layer 105: An outer coating layer 132 is printed and formed on surface of the inner coating layer 131. The outer coating layer 132 has a size larger than the inner coating layer 131 and is in touch with a part of the front terminal electrode 11*c* of the base metal or base-metal alloy. The rest part of the front terminal electrode 11*c* of the base metal or base-metal alloy is exposed out. Then, the substrate 10 is sent into a sintering furnace to be sintered at a temperature of 150~250° C., so that the outer coating layer 132, the inner coating layer 131 and the part of the front terminal electrode 11*c* are sintered altogether. A protective layer 13 comprising the outer coating layer 132 and the inner coating layer 131 is formed. Therein, the outer coating layer 132 is of an insulating material mainly composed of epoxy resin.

(g) Printing code layer 106: A layer printed with an identification code, like resistor type, resistance value, etc., is formed on the protective layer 13 to represent the chip resistor.

(h) Breaking into strips 107: A whole sheet of the substrate 10 is sent into a rolling device to be broken into strips in a rolling-cutting way.

(i) Printing side terminal electrodes with edges 108: A conductive material is printed on two sides of the strips of the substrate 10 to form two side terminal electrodes 14 over at two ends of the outer coating layer 132. The side terminal electrodes 14 cover the front terminal electrode 11*c* of the base metal or base-metal alloy; and the back terminal electrodes 12. After printing the side terminal electrodes 14 with edges, the strips of the substrate 10 are sintered in a sintering furnace at a temperature of 150~250° C. The side terminal electrodes 14, the front terminal electrode 11*c* of the base metal or base-metal alloy, and the back terminal electrodes 12 are thus sintered together. The front terminal electrode 11*c* of the base metal or base-metal alloy is thus connected and conducted with the two back terminal electrodes 12 at two sides of the strips of the substrate 10 separately. The side terminal electrodes 14 are in touch with the front terminal electrode 11*c* of the base metal or base-metal alloy and are connected to the resistor layer 11*d* of the base metal or base-metal alloy. Therein, the side terminal electrodes 14 are metal electrodes of copper (Cu), nickel (Ni) or their combination.

(j) Breaking into dices 109: After sintering the side terminal electrodes 14, the strips of the substrate 10 are broken into dices with the rolling device. The strips of the substrate 10 comprises the dices originally-connected to be broken into independent ones; and each independent one of the dices comprises the front terminal electrode 11*c* of the base metal or base-metal alloy, the resistor layer 11*d* of the base metal or base-metal alloy, the two back terminal electrodes 12 having the low resistance potential, the two side terminal electrodes 14, and the protective layer 13 comprising the inner coating layer 131 and the outer coating layer 132.

(k) Electroplating 110: Each independent one of the dices is electroplated with Ni and Sn in a plating trough to form a plated layer 15 over each one of the side terminal electrodes 14. Therein, the plated layer 15 comprises a layer of plated Ni and a layer of plated Sn; Ni is used to protect the front terminal electrode 11*c* of the base metal or base-metal alloy; the chip resistor is soldered on a printed circuit board (PCB) with Sn; and the front terminal electrode 11*c* of the base metal or base-metal alloy is used in an application, like a vehicle, a base station, a LED light, etc., of the chip resistor anti-sulfured.

Thus, a novel method of fabricating a highly conductive low-ohmic chip resistor having electrodes of base metal or base-metal alloy is obtained.

Figure 2A:
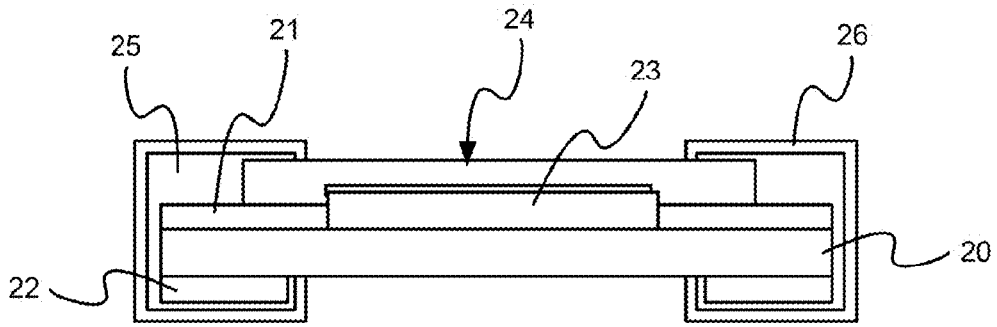
FIG. 2A and FIG. 2B are the cross-sectional views showing the structures of the prior art and the present invention.

The original structure shown in FIG. 2A fabricated through the original procedure is changed by the present invention. The original structure prints two front terminal electrodes 21 and two back terminal electrodes 22 above and below a substrate 20, respectively. Then, a high-temperature sintering is processed. Then, a resistor layer 23 is printed to be sintered again. Then, a protective layer 24, side terminal electrodes 25 and a plated layer 26 are formed as follows. In the above original structure, the front terminal electrodes 21 and the resistor layer 23 can be clearly distinguished, where interface between the front terminal electrodes 21 and the resistor layer 23 exists. The existence of the interface will affect resistance characteristics of a low-ohmic (<10 ohms) chip resistor for production.

Figure 2B:
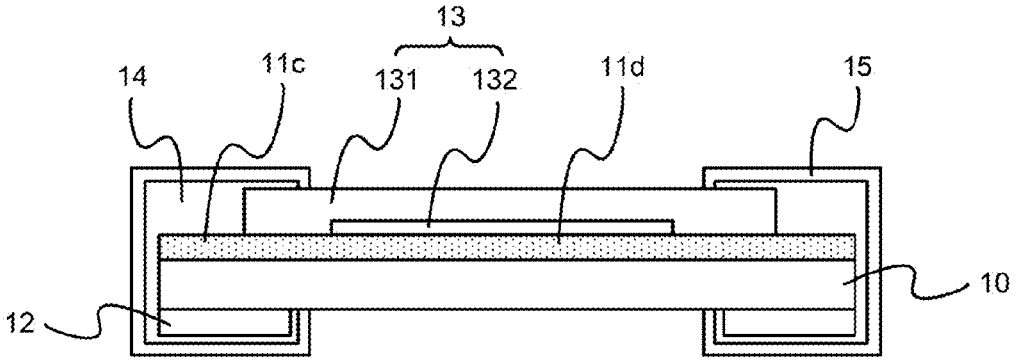

The novel structure of the chip resistor fabricated according to the present invention is shown in FIG. 2B. A front terminal electrode of Al or Sn having a low reduction potential is formed along with a resistor layer of the same material integrally. There is no interface resistance existing between a front terminal electrode of Al or Sn having a low reduction potential and a resistor layer. Hence, the present invention is of great help to stability of resistance characteristics of a low-ohmic (<10 ohms) chip resistor for production.

The wet-chemical alternation reaction used in the present invention for fabricating the chip resistor is shown in FIG. 1. The fabrication has three main differences. The first difference is that a thick paste of Al or Sn having a low reduction potential is printed to cover all over a front terminal electrode of Al or Sn having the low reduction potential and a resistor layer. After a high-temperature sintering is processed, the second difference is that a dip-plating alternation reaction is processed by immersing the thick paste of Al or Sn as a sacrificial layer in a base-metal solution having a high reduction potential. For example, the thick paste of Al or Sn having the low reduction potential is immersed in a solution of copper sulfate or a solution of Ni sulfate. Therein, ions of Cu reduce Al or Sn having the low reduction potential to obtain a Cu front terminal electrode and a Cu resistor layer; or ions of Ni reduce Al or Sn having the low reduction potential to obtain a Ni front terminal electrode and a Ni resistor layer. Or, the thick paste of Al or Sn having the low reduction potential is immersed in a solution of copper sulfate and nickel sulfate. Therein, ions of Cu and Ni simultaneously reduce Al or Sn having the low reduction potential to obtain a front terminal electrode and a resistor layer both of an alloy of Cu and Ni for the low-ohmic chip resistor. The fabrication of the low-ohmic chip resistor can use electroplating to form the Cu front terminal electrode and the Cu resistor layer; the Ni front terminal electrode and the Ni resistor layer; or the front terminal electrode and the resistor layer both of the alloy of Cu and Ni. The third difference is that, after being dip-plated or electroplated, the front terminal electrode and the resistor layer both of the base metal or base-metal alloy are dried in the air or are further sintered under a low-temperature reduction atmosphere. The other fabrication steps are the same as those used in fabricating the traditional chip resistor.

Figure 3:
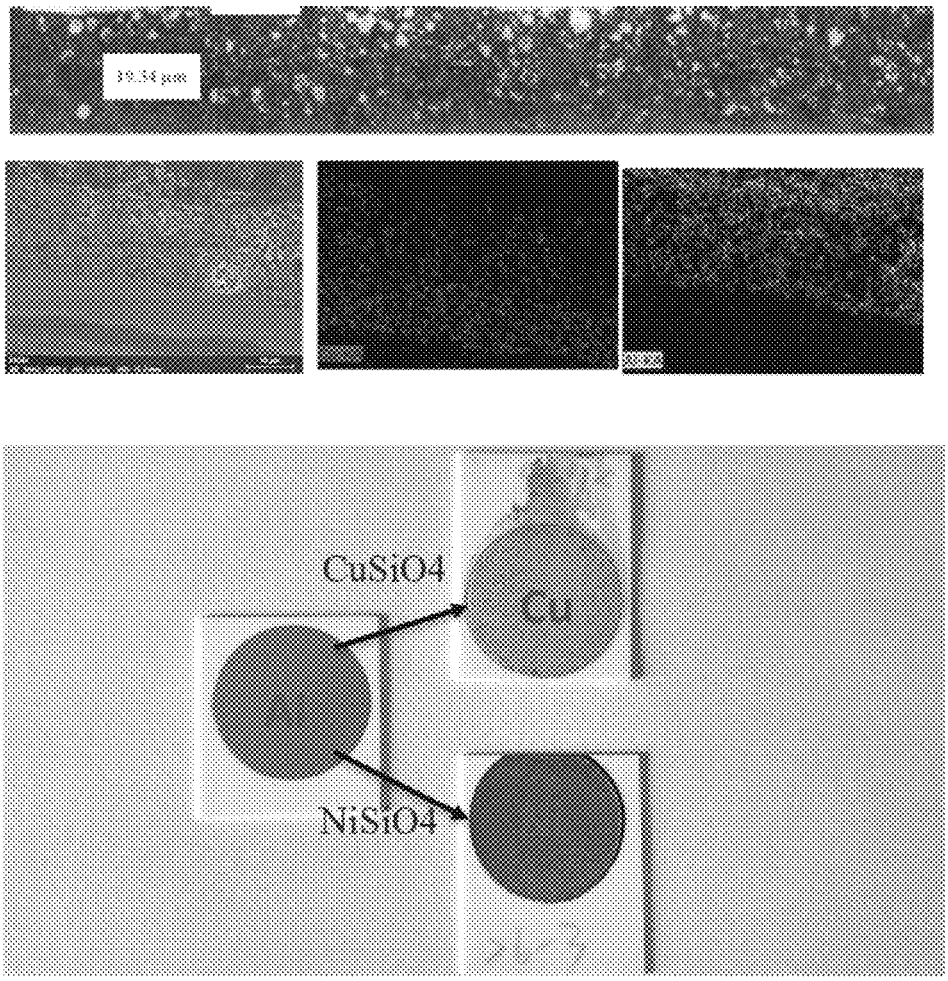
FIG. 3 is the view showing the thick pastes obtained after the wet-chemical alternation reaction.
Figure 4A:
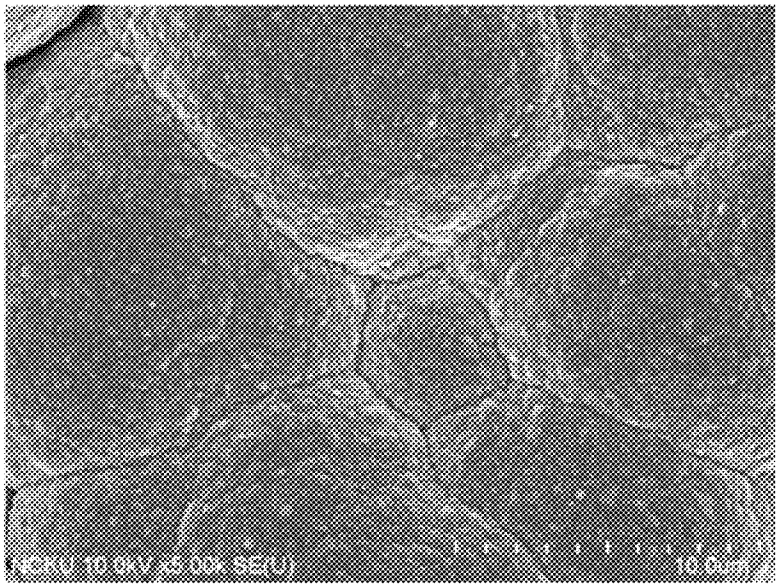
FIG. 4A and FIG. 4B are the views showing the micro-structures of the thick pastes.
Figure 4B:
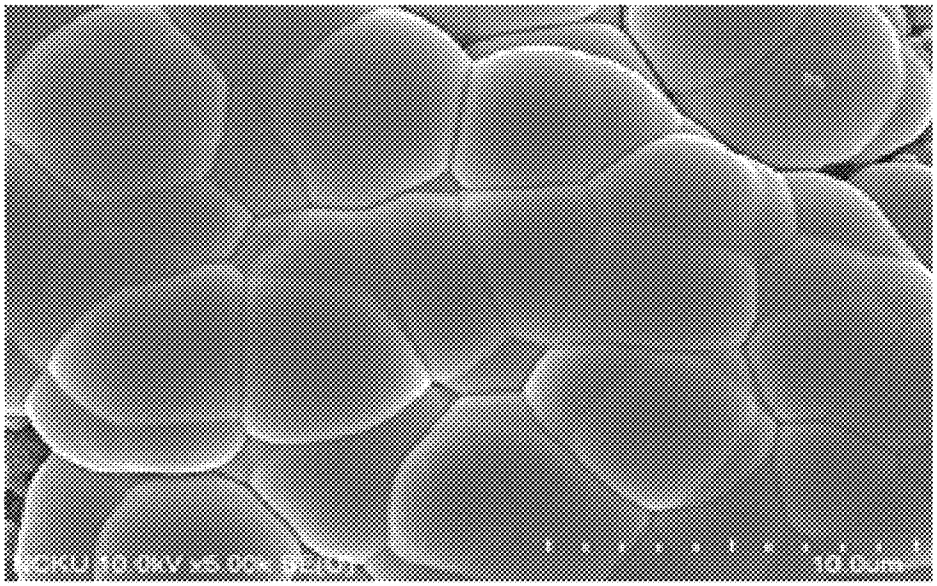

As described above, the base metal is sintered in the air in the novel fabrication according to the present invention, where the Al (or Sn) thick paste having the low reduction potential is printed and sintered. Then, since the Al thick paste has the reduction potential lower than Cu and Ni, the alternation reaction can be processed to oxidize Al into Al ions and, at the same time, reduce base-metal ions of Cu and Ni into metal Cu and Ni, as shown in FIG. 3.

TABLE 1

| | Reduction potential (E°/V) |
|---|---|
| $Al^{3+}_{(aq)} + 3e^- \leftrightarrow Al_{(s)}$ | −1.662 |
| $Sn^{4+}_{(aq)} + 4e^- \leftrightarrow Sn_{(s)}$ | −0.136 |

TABLE 1-continued

| | Reduction potential (E°/V) |
|---|---|
| $Cu^{2+}_{(aq)} + 2e^- \leftrightarrow Cu_{(s)}$ | +0.342 |
| $Ni^{2+}_{(aq)} + 2e^- \leftrightarrow Ni_{(s)}$ | −0.257 |
| $Mn^{2+}_{(aq)} + 2e^- \leftrightarrow Mn_{(s)}$ | −1.185 |

In other words, the present invention uses a novel manufacturing technology where a thick-film Al or Sn electrode having a low reduction potential are printed and sintered in the air and bound to a substrate; then, an alternation reaction is used to reduce Al or Sn to Cu or Ni in the base-metal electrode, where the thick-film Al or Sn electrode having the low reduction potential is used as a sacrificial layer in the alternation reaction. The sacrificial layer in the alternation reaction not only can be used to fabricate the base-metal electrode, such as the micro-structure of the electrode having Al replaced by Cu shown in FIG. 4A; but also can be used to be immersed in a solution with different ions for making an alloy with different content ratio, such as a CuNi (52/48) alloy shown in FIG. 4B.

Figure 5A:
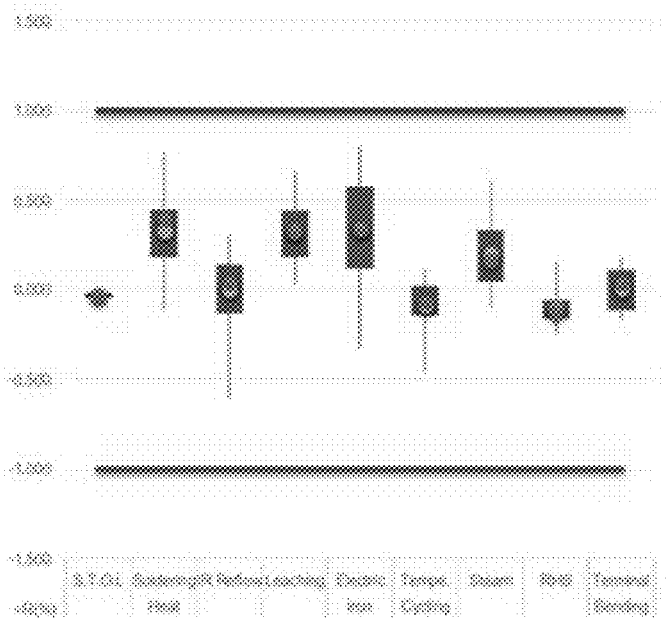
FIG. 5A and FIG. 5B are the views showing the electrical characteristics.
Figure 5A:
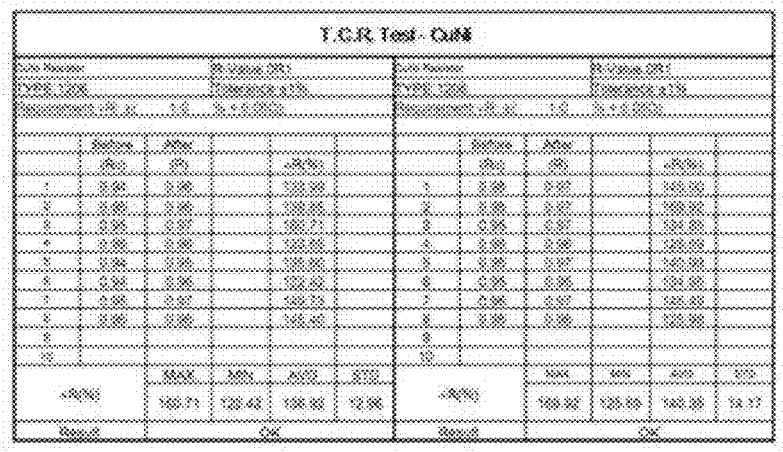
Figure 5B:
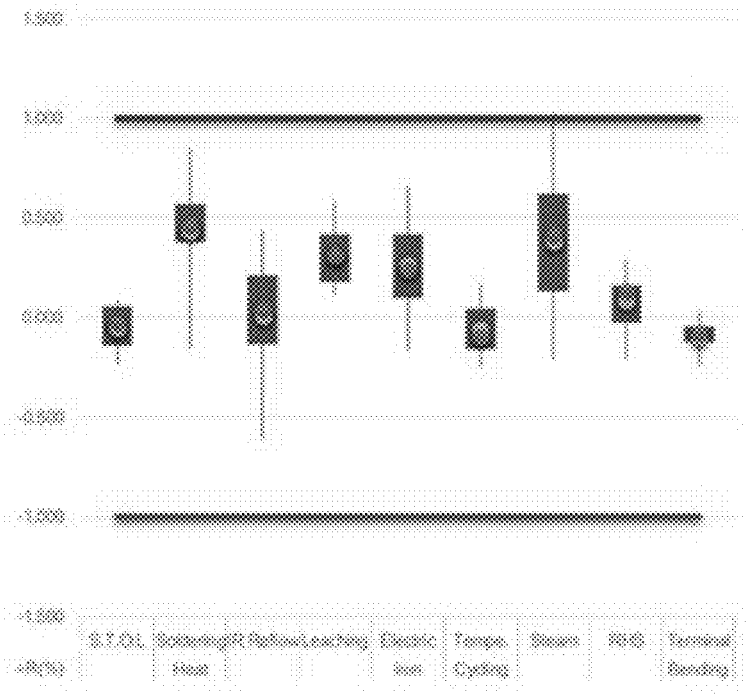
Figure 5B:
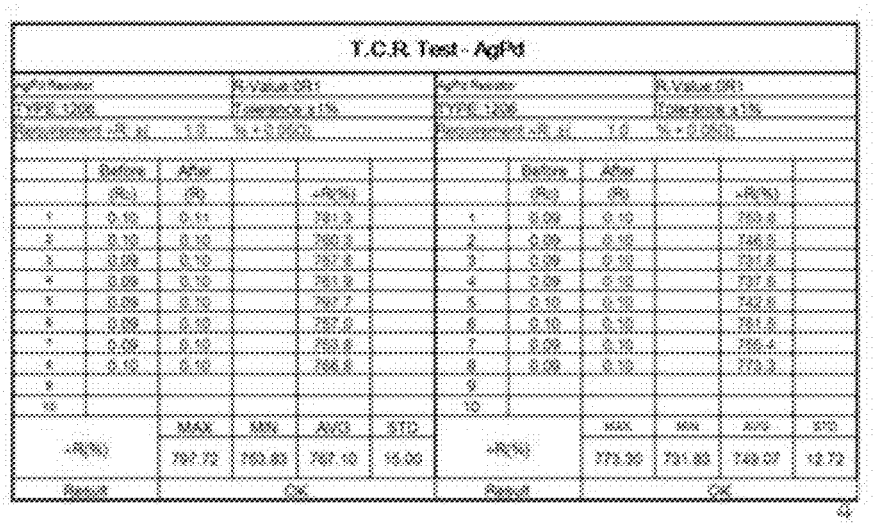

A CuNi low-ohmic chip resistor fabricated according to the present invention is compared with a conventional thick-film printed silver-palladium (AgPd) low-ohmic chip resistor on their electrical characteristics and reliability, as shown in FIG. 5A and FIG. 5B. Basically, the CuNi low-ohmic chip resistor fabricated through the wet-chemical alternation reaction according to the present invention has quite the similar characteristics and reliability as the conventional thick-film printed AgPd low-ohmic chip resistor. The CuNi low-ohmic chip resistor fabricated according to the present invention also passes 1000 hours of a long-term life test, which shows a performance the same as the conventional AgPd low-ohmic chip resistor. Yet, as compared to the conventional thick-film printed AgPd low-ohmic chip resistor, the novel thick-film printed CuNi low-ohmic chip resistor fabricated through the wet-chemical alternation reaction according to the present invention has a better resistance-temperature characteristic.

Table 2 compares materials and processes for fabricating low-ohmic chip resistors. Conventional chip resistor mainly uses AgPd alloy, which not only uses expensive noble metals but also has a temperature coefficient of resistance (TCR) too high to meet requirement in the market. Although the TCR of CuNi or copper-manganese (CuMn) alloy can be improved by screen printing, sintering under reduction atmosphere, thin-film sputtering, surface-mounting, and punching, during fabricating the low-ohmic chip resistor, the material cost or even the manufacture cost is still too high to be competitive in the market. The CuNi low-ohmic chip resistor fabricated through the wet reaction with thick-film printing according to the present invention not only has excellent resistance-temperature characteristic, but also superior material cost and manufacture cost.

TABLE 2

| Alloy | AgPd | | CuNi | | CuMn | |
|---|---|---|---|---|---|---|
| Material | thick-film AgPd paste | thick-film CuNi paste | Cu, Ni target | thick-film Al paste + CuNi solution | CuMn dice | CuMn strip |
| Process | screen printing | screen printing | sputtering | screen printing + wet process (electroplating) | surface mount | punch |
| Structure | front contact + resistor | front contact + resistor | front contact + resistor | one piece integrated | one piece integrated | one piece integrated |
| Heat treatment | air sintering | helium sintering | helium annealing | N/A (helium annealing) | N/A | N/A |
| Resistor layer thickness | <10 μm | <10 μm | <1-3 μm | 10 μm < <100 μm | 100 μm | 1-2 mm |
| Resistance range | 100 mΩ-1 Ω | 100 mΩ-1 Ω | 100 mΩ-50 Ω | 50 mΩ-10 Ω | 50 mΩ-100 mΩ | 10 mΩ-50 Ω |
| TCR | 400 ppm | 100 ppm | 100 ppm | 100 ppm | 100 ppm | 100 ppm |
| Material cost | very expensive | expensive | less expensive | cheap | very expensive | very expensive |
| Manufacture cost | cheap | expensive | expensive | cheap | less expensive | expensive |

The present invention proposes a method for fabricating an electrode and a resistor layer of a base metal or base-metal alloy with thick-film printing at a low temperature in the air. Therein, a thick-film paste made of a cheap low-reduction-potential metal (such as Al or Ni) is formed through screen printing and sintering; and, then, the layer of the cheap low-reduction-potential metal is used as a sacrificial layer to be immersed in a metal solution having a high reduction potential to process a wet chemical alternation reaction for, consequently, obtaining a metal electrode having the high reduction potential. Or, the sacrificial layer may be immersed in a mixed solution of several different metal having high reduction potential to process wet chemical alternation reaction for obtaining an alloy of metals mixed with different composition. Accordingly, the present invention expels the traditional feature that an electrode of a base metal or base-metal alloy is fabricated through a heat treatment under a high-temperature reduction atmosphere only. The present invention greatly improves the manufacture cost of the base-metal or base-metal-alloy electrodes in the market; and significantly enhances efficiency in the technical level with the thick-film printing combined.

To sum up, the present invention is a method of fabricating a highly conductive low-ohmic chip resistor having an electrode of a base metal or base-metal alloy, where a base-metal or base-metal-alloy electrode is fabricated in the air under a low temperature and the manufacture cost of the base-metal or base-metal-alloy electrode can be greatly deceased in the market.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A method of fabricating a highly conductive low-ohmic chip resistor having an electrode of base metal or base-metal alloy, comprising steps of:

(a) printing and sintering terminal electrodes and resistor layer, comprising steps of:

(a1) printing two back terminal electrodes on a first surface of a substrate, wherein said two back terminal electrodes are spaced and unconnected and are of a first base metal having a lower reduction potential;

(a2) printing a thick paste to cover all over a second surface of said substrate opposite to said first surface of said substrate, wherein said thick paste comprises a front terminal electrode and a resistor layer; said front terminal electrode and said resistor layer are of said first base metal having said lower reduction potential; and said front terminal electrode and said resistor layer are thus obtained integrally without interface therebetween; and (a3) sintering said substrate in a sintering furnace at a high temperature of 200~900 celsius degrees (° C.), wherein said two back terminal electrodes, together with said thick paste comprising said front terminal electrode and said resistor layer, are thus bound to said substrate;

(b) plating, comprising a step of:

immersing said thick paste as a sacrificial layer in a base-metal solution having a higher reduction potential than said first base metal to obtain said front terminal electrode and said resistor layer both of a base-metal material having said higher reduction potential though a wet-chemical alternation reaction, wherein said wet-chemical alternation reaction is processed by a plating method selected from a group consisting of dip-plating and electroplating;

(c) processing heat treatment, comprising a step of:

drying said front terminal electrode and said resistor layer in the air;

(d) printing and sintering inner coating layer, comprising steps of:

(d1) printing an inner coating layer on said resistor layer, wherein said inner coating layer has a size equal to said resistor layer and is not in touch with said front terminal electrode; and (d2) sending said substrate into a sintering furnace to sinter said inner coating layer and said resistor layer altogether at a temperature of 150~700° C.;

(e) laser-cutting, comprising a step of:

sending said substrate into a laser-cutting device to cut said resistor layer with a laser penetrating through said inner coating layer, wherein an adjusting groove is cut out from said resistor layer by said laser to modify a resistance of said resistor layer;

(f) printing and sintering outer coating layer, comprising steps of:

(f1) printing and forming an outer coating layer on surface of said inner coating layer, wherein said outer coating layer has a size larger than said inner coating layer and is in touch with a part of said front terminal electrode; and the rest part of said front terminal electrode is exposed out; and (f2) sending said substrate into a sintering furnace to sinter said outer coating layer, said inner coating layer and said part of said front terminal electrode altogether at a temperature of 150~250° C., wherein a protective layer comprising said outer coating layer and said inner coating layer is obtained;

(g) printing code layer, comprising a step of:

obtaining a layer printed with an identification code on said protective layer to represent the chip resistor;

(h) breaking into strips, comprising a step of:

sending a whole sheet of said substrate into a rolling device to be broken into strips in a rolling-cutting way;

(i) printing side terminal electrodes with edges, comprising steps of:

(i1) printing a conductive material on two side surfaces of said strips of said substrate to obtain two side terminal electrodes over at two ends of said outer coating layer, wherein said side terminal electrodes cover said front terminal electrode and said back terminal electrodes; and (i2) sintering said strips of said substrate in a sintering furnace at a temperature of 150~250° C., wherein said side terminal electrodes, said front terminal electrode and said back terminal electrodes are thus sintered together; said side terminal electrodes are in touch with said front terminal electrode and are connected to said resistor layer; and said front terminal electrode is thus connected and conducted with said two back terminal electrodes at two sides of said strips of said substrate separately;

(j) breaking into dices, comprising a step of:

breaking said strips of said substrate into dices with said rolling device, wherein said strips of said substrate comprises said dices originally-connected to be broken into independent ones; and each independent one of said dices comprises said front terminal electrode, said resistor layer, said two back terminal electrodes, said two side terminal electrodes, and said protective layer comprising said inner coating layer and said outer coating layer; and (k) electroplating, comprising a step of:

electroplating each independent one of said dices with a first metal and a second metal in a plating trough to obtain a plated layer over each one of said side terminal electrodes, wherein said first metal protects said front terminal electrode; and the chip resistor is soldered on a printed circuit board (PCB) with said second metal.

2. The method according to claim 1, wherein, in step (a), said first base metal is selected from a group consisting of aluminum (Al) and Sn.

3. The method according to claim 1, wherein, in step (b), said base-metal solution is selected from a group consisting of a solution of copper sulfate; a solution of nickel sulfate; and a solution of copper sulfate and nickel sulfate.

4. The method according to claim 1, wherein, in step (b), said base-metal solution is a solution of at least one second base metal having said higher reduction potential; and ions of said at least one second base metal reduce said first base metal in said wet-chemical alternation reaction.

5. The method according to claim 4, wherein said at least one second base metal is selected from a group consisting of copper (Cu), nickel (Ni), and both Cu and Ni.

6. The method according to claim 1, wherein, in step (b), said base-metal material is selected from a group consisting of Cu, Ni, and an alloy of Cu and Ni.

7. The method according to claim 1, wherein, in step (c), said heat treatment further comprises a step of sintering under a low-temperature reduction atmosphere.

8. The method according to claim 1, wherein, in step (k), said first metal is Ni and said second metal is Sn.

9. The method according to claim 1, wherein said front terminal electrode is used in an application of the chip resistor anti-sulfured and said application is selected from a group consisting of a vehicle, a base station and a LED light.

10. The method according to claim 1, wherein the chip resistor has a resistance between 10 milli-ohms and 100 ohms.

* * * * *